US011358817B2

(12) United States Patent
Hong et al.

(10) Patent No.: US 11,358,817 B2
(45) Date of Patent: Jun. 14, 2022

(54) SKEW CORRECTION STRUCTURE

(71) Applicant: Foxlink Image Technology Co., Ltd., New Taipei (TW)

(72) Inventors: I Chuan Hong, New Taipei (TW); Lung Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 17/168,178

(22) Filed: Feb. 5, 2021

(65) Prior Publication Data

US 2022/0144569 A1 May 12, 2022

(30) Foreign Application Priority Data

Nov. 12, 2020 (CN) ..... 202022615172.3

(51) Int. Cl.
*B65H 7/08* (2006.01)
*B65H 20/02* (2006.01)
*B65H 9/04* (2006.01)

(52) U.S. Cl.
CPC ..... *B65H 7/08* (2013.01); *B65H 9/04* (2013.01); *B65H 20/02* (2013.01); *B65H 2301/331* (2013.01); *B65H 2404/15212* (2013.01); *B65H 2701/1315* (2013.01); *B65H 2701/1914* (2013.01); *B65H 2801/39* (2013.01)

(58) Field of Classification Search
CPC .... B65H 2301/331; B65H 9/04; B65H 9/004; B65H 9/14; G06K 13/063
See application file for complete search history.

(56) References Cited

U.S. PATENT DOCUMENTS 3,947,022 A * 3/1976 Kockler ..... G06K 13/063 271/250
4,795,891 A * 1/1989 Morigaki ..... G06K 13/08 235/380
5,648,651 A * 7/1997 Inoue ..... G06K 13/06 235/475
2006/0244207 A1* 11/2006 Riester ..... G01P 1/16 271/207

* cited by examiner

*Primary Examiner* — Jeremy R Severson
(74) *Attorney, Agent, or Firm* — Lin & Associates Intellectual Property, Inc.

(57) ABSTRACT

A correction structure arranged in a feeding path of a document processing device, comprising: a transmitting means consisted of at least a pair of roller sets which are arranged symmetrically on the two sides of the feeding path for transmitting the card evenly, a correcting means consisted of a platform movably arranged at the downstream to the roller set, a receptacle formed on the platform, an elastic object arranged in the receptacle for returning the platform to a predefined location, a back wall extended from the platform toward the feeding path, an opening formed on the back wall to let a card go through, and a friction pad arranged at the bottom of the opening to partly jam the opening, wherein the width of the friction pad is less than the width of the feeding path so the friction pad only contacts the center of the card while transmitting the card.

20 Claims, 14 Drawing Sheets

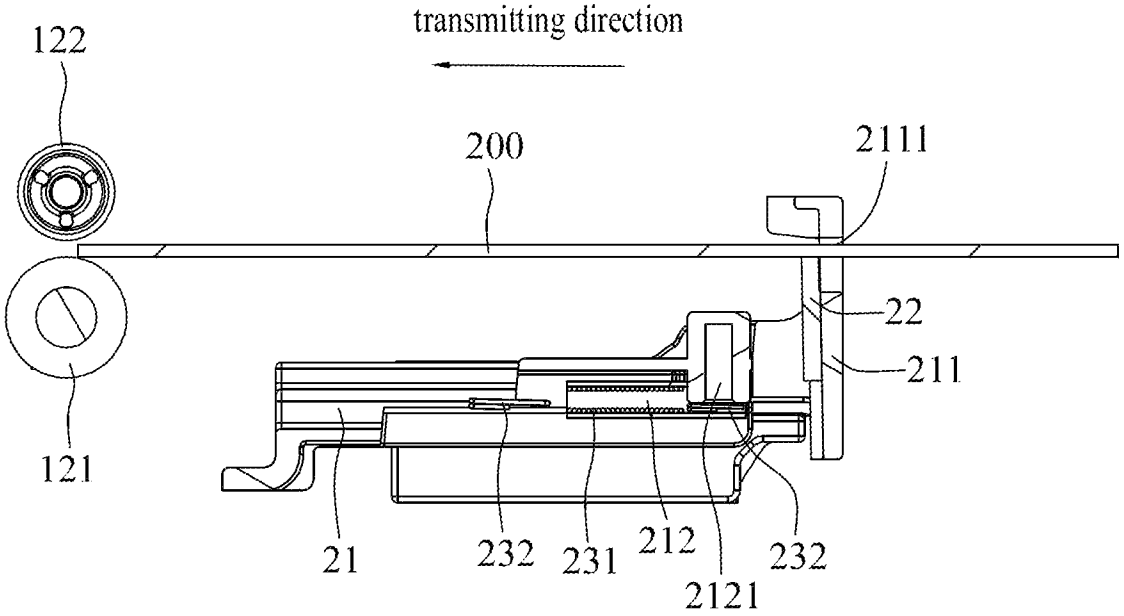
FIG. 11
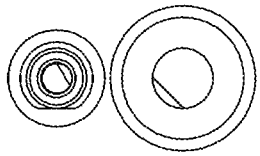

SKEW CORRECTION STRUCTURE

CROSS-REFERENCE TO RELATED APPLICATION

The present application is based on, and claims priority from, China Patent Application No. 202022615172.3, filed Nov. 12, 2020, the disclosure of which is hereby incorporated by reference herein in its entirety.

BACKGROUND OF THE INVENTION

1. Field of the Invention

This invention relates to a skew correction structure, in particular to a correction structure which corrects the skew of the card as transmitting the card.

2. The Related Art

A card scanner is used for scanning cards, however, if a user places a card in the card scanner in a skewed state during the scanning process, the scanned image will be skewed. If the card is skewed too much, the card may not located within the scanning area of the card scanner, and it is resulting in image miss. In this case, the user has to straighten the card and scan the card again in order to get a proper image. The manual operation causes inconvenience to correct the skew of the card.

Therefore it is necessary to provide a correction structure which corrects the skew of the card as transmitting the card.

SUMMARY OF THE INVENTION

The objective of the present invention is to provide a correction structure, in particular to a correction structure which corrects the skew of the card as transmitting the card.

A skew correction structure which is arranged along a feeding path of a document processing product for correcting a card, comprising: a transmitting device having at least a pair of roller sets which are arranged symmetrically on the two sides of the feeding path for transmitting the card evenly; a correcting device arranged at a downstream position of the feeding path, the correcting device having a platform movably arranged to parallel with the feeding path, an elastic object connected between the platform and the document processing product, a back wall extended from the platform and blocking the feeding path, an opening penetrating the back wall and communicating with the feeding path, a friction pad arranged at the back wall and blocking a middle of the opening from one of two long edges of the opening; wherein a width of the friction pad is less than a width of the feeding card, the friction pad contacts a center of the card when the card is corrected.

In a preferred embodiment, wherein the roller set comprises at least one transmitting roller and at least one idle roller arranged on a top of the transmitting roller, and the quantity of the idle roller is equal to the quantity of the transmitting roller.

In a preferred embodiment, wherein the friction pad is arranged on an inner surface of the back wall.

In a preferred embodiment, wherein the friction pad is arranged on an outer surface of the back wall.

In a preferred embodiment, wherein the elastic object is a spring.

In a preferred embodiment, wherein two rings are arranged on two ends of the spring respectively, one of the rings is connected to the platform and the other ring is secured on the document processing product.

In a preferred embodiment, wherein a securing hole is formed in the receptacle, one of the rings is positioned on the securing hole to be secured via a securing means for securing the ring to the platform.

In a preferred embodiment, wherein a low-friction pad is arranged between the friction pad and the back wall.

In a preferred embodiment, wherein a low-friction pad is adhered between the friction pad and the back wall.

In a preferred embodiment, wherein the correcting device comprises a pair of lateral guiders, the opening has opposite short edges, and the lateral guiders are positioned at an inner surface of the back wall and neighbored the short edges of the opening.

In a preferred embodiment, wherein inner surfaces of the lateral guiders are formed as an oblique surface for guiding lateral edges of the card.

In a preferred embodiment, wherein the correcting device comprises a middle guider, the middle guider is positioned at an inner surface of the back wall and neighbored on a middle of the other long edge of the opening.

In a preferred embodiment, wherein an inner surface of the middle guider is formed as an oblique surface for guiding a front edge of the card.

In a preferred embodiment, wherein the friction pad arranged at a bottom of the opening, a top of the friction pad fully blocks the middle of the opening, a top edge of friction pad and an upper edge of the opening are substantially at the same level along an up-down direction seen from a lateral side of the skew correction structure.

In a preferred embodiment, wherein the friction pad arranged at a top of the opening, a bottom of the friction pad fully blocks the middle of the opening, a bottom edge of friction pad and an lower edge of the opening are substantially at the same level along an up-down direction seen from a lateral side of the skew correction structure.

A skew correction structure which is arranged along a feeding path of a document processing product for correcting a card, comprising: a platform movably arranged in parallel with the feeding path; an elastic object connected between the platform and the document processing product; a back wall extended from the platform and blocking the feeding path; an opening penetrating the back wall and communicating with the feeding path; a friction pad arranged at the back wall and blocking a middle of the opening from a long edge of the opening; wherein, when the card is transmitted in the feeding path and inside the document processing product, the platform is positioned in the document processing product and a front edge of the card has not yet been connected the friction pad; when the card is transmitted and the front edge of the card connects the friction pad, the platform is extending out from the document processing product; when the card is transmitted and the front edge of the card has crossed the friction pad and passed through the opening, the card is corrected via a transmission force and a friction between the friction pad and a center of a surface of the card.

A skew correction structure which is arranged along a feeding path of a document processing product for correcting a card, comprising: a platform movably arranged in parallel with the feeding path; an elastic object connected between the platform and the document processing product; a back wall extended from the platform and blocking the feeding path; an opening penetrating the back wall and communicating with the feeding path; a friction pad arranged at the back wall and blocking a middle of the opening from one of two long edges of the opening.

In a preferred embodiment, wherein a low-friction pad is adhered between the friction pad and an inner surface of the back wall.

In a preferred embodiment, wherein the back wall has a pair of lateral guiders, the opening has opposite short edges, and the lateral guiders are positioned at the inner surface of the back wall and neighbored the short edges of the opening.

In a preferred embodiment, wherein the back wall has a middle guider, the middle guider is positioned at the inner surface of the back wall and neighbored on a middle of the other long edge of the opening.

BRIEF DESCRIPTION OF THE DRAWINGS

The present invention will be apparent to those skilled in the art by reading the following description, with reference to the attached drawings, in which:

FIG. 11 is a sectional view alone line XI-XI shown in FIG. 10.

DETAILED DESCRIPTION OF THE PREFERRED EMBODIMENT

Figure 1:
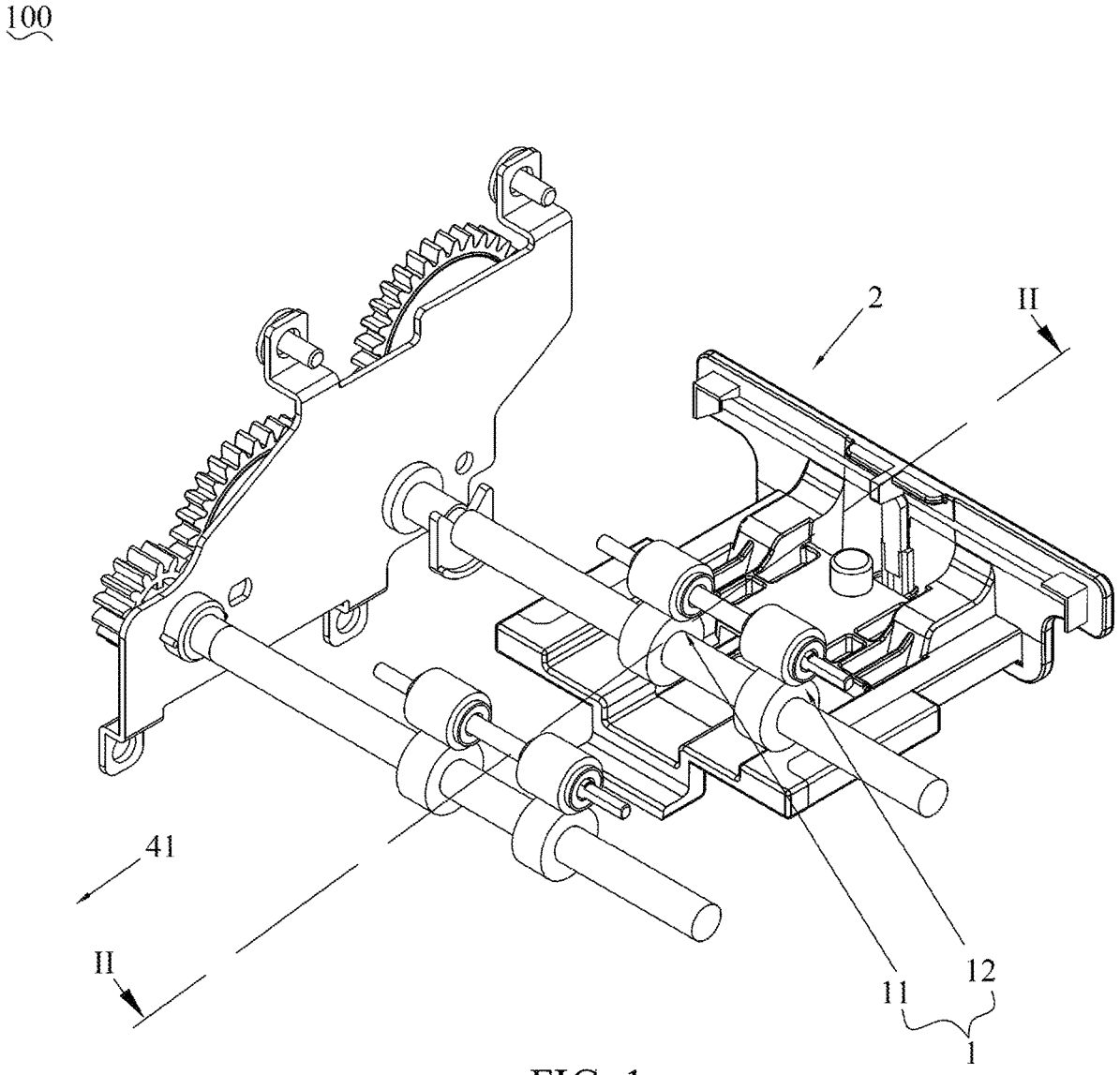
FIG. 1 is a perspective view of a correction structure in this invention.

Reference will now be made in detail to embodiments, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the embodiments.

Referring to FIG. 1 to FIG. 4, the correction structure 100 in this invention has a transmitting device 1 and a correcting device 2. The correction structure 100 is applied in a document processing product (not show) such as scanner, printer and etc. The document processing product has a feeding path 4 for transmitting a card 200 (shown in FIG. 5). The correcting device 2 is arranged at a downstream position of the feeding path 4 of the document processing product.

The transmitting device 1 is arranged at an upstream position of the feeding path 4 relative to the correction device 2. The transmitting device 1 is arranged to feed the card 200 which is transmitted toward the downstream position or the upstream position from an entrance 41 of the feeding path 4. The entrance 41 is positioned at the upper position of the feeding path 4 relative to the transmitting device 1. The transmitting device 1 in this embodiment has a first roller set 11 and a second roller set 12 which are arranged symmetrically on an upper side and a lower side of the feeding path 4 for transmitting the card 200 evenly. The first roller set 11 has a first transmitting roller 111 and a first idle roller 112 cooperated with the first transmitting roller 111. The second roller set 12 has a second transmitting roller 121 and a second idle roller 122 cooperated with the second transmitting roller 121. The first idle roller 112 and the second idle roller 121 are arranged on tops of the first transmitting roller 111 and the second transmitting roller 121 respectively for assisting the first transmitting roller 111 and the second transmitting roller 121 to clamp the card 200. The first idle roller 112 and the second idle roller 121 prevent the card 200 being loosed with the first transmitting roller 111 and the second transmitting roller 121. The quantity of the idler roller 112, 122 is equal to the quantity of the transmitting roller 111, 121.

The first roller set 11 and the second roller set 12 are both connected with a motor (not shown) via at least one transmission gear 3. By switching the rotating direction of the motor, the transmission gear 3 drives the first roller set 11 and the second roller set 12 to rotate forward or backward. Thus the card 200 is transmitted forward to the downstream position or backward to the upstream position.

Referring to FIG. 1 to FIG. 4, the correcting device 2 has a platform 21 movably arranged at the downstream position relative to the first roller set 11 and the second roller set 12, a receptacle 212 formed on the platform 21, an elastic object 23 such as a spring 231 positioned in the receptacle 212 for returning the platform 21 to a predefined location, a back wall 211 extended from the platform 21 and into the feeding path 4, an opening 2111 formed on the back wall 211 to let the card 200 go through, and a friction pad 22 arranged at a bottom of the opening 2111 to partly jam the opening 2111.

The platform 21 is positioned below the feeding path 4 and is arranged to parallel with the feeding path 4. The platform 21 has a downstream end and an upstream end opposite to the downstream end. The upstream end of the platform 21 is near the first roller set 11 and the second roller set 12 of the transmitting device 1. The downstream end of the platform 21 is away from the first roller set 11 and the second roller set 2 of the transmitting device 1. The platform 21 is moved along the feeding path 4. The platform 21 is able to move to a correction location or the predefined location. When the platform 21 is in predefined location, the upstream end of the platform 21 is near the first roller set 11 and the second roller set 12. When the platform 21 is in the correction location, the upstream end of the platform 21 is away from the first roller set 11 and the second roller set 12.

In this case, when the platform 21 is in the predefined location, the upstream end of the platform 21 overlaps the first roller set 11 and the second roller set 12 seen from lateral sides of the skew correction structure 100. The receptacle 212 is extended along the feeding path 4. The back wall 211 vertically extends from the downstream end of the platform 21 to block the feeding path 4. The opening 2111 is penetrated a top of the back wall 211. The friction pad 22 is adhered to a middle of an inner surface of the back wall 211. A top of the friction pad 22 blocks a middle of the opening 2111 along an up-down direction which is vertically to the feeding path 4. Wherein a width of the friction pad 22 is less than a width of the opening 2111 and a with of the card 200. So the friction pad 22 contacts a center of the card 200 while the transmitting device 1 transmitting the card 200. In this case, the top of the friction pad 22 fully blocks the middle of the opening 2111. Seen from the lateral sides of the skew correction structure 100, a top edge of friction pad 22 and an upper edge of the opening 2111 are substantially at the same level along the up-down direction. Additionally, the friction pad 22 can be adhered to a middle of an outer surface of the back wall 211.

The back wall 211 has a pair of lateral guiders 24 and a middle guider 25. The opening 2111 has the upper edge, a lower edge opposite to the upper edge and opposite lateral edges connected two ends of the upper edge and two ends of the lower edge. In this case, a length of the upper edge is longer than a length of the lateral edge. The lateral guiders 24 are positioned at the inner surface of the back wall 211 and neighbored the lateral edges of the opening 2111. The middle guider 25 is positioned at the inner surface of the back wall 211 and neighbored on a middle of the upper edge of the opening 2111. Inner surfaces of the lateral guiders 24 are formed as an oblique surface for guiding lateral edges of the card 200. A lower surface of the middle guider 25 is formed as an oblique surface for guiding a front edge of the card 200. In other case, the middle guider 25 can be neighbored on a middle of the lower edge of the opening 2111. So, the friction pad 22 is arranged at a top of the opening 2111. A bottom edge of friction pad 22 and a lower edge of the opening 2111 are substantially at the same level along the up-down direction.

Figure 2:
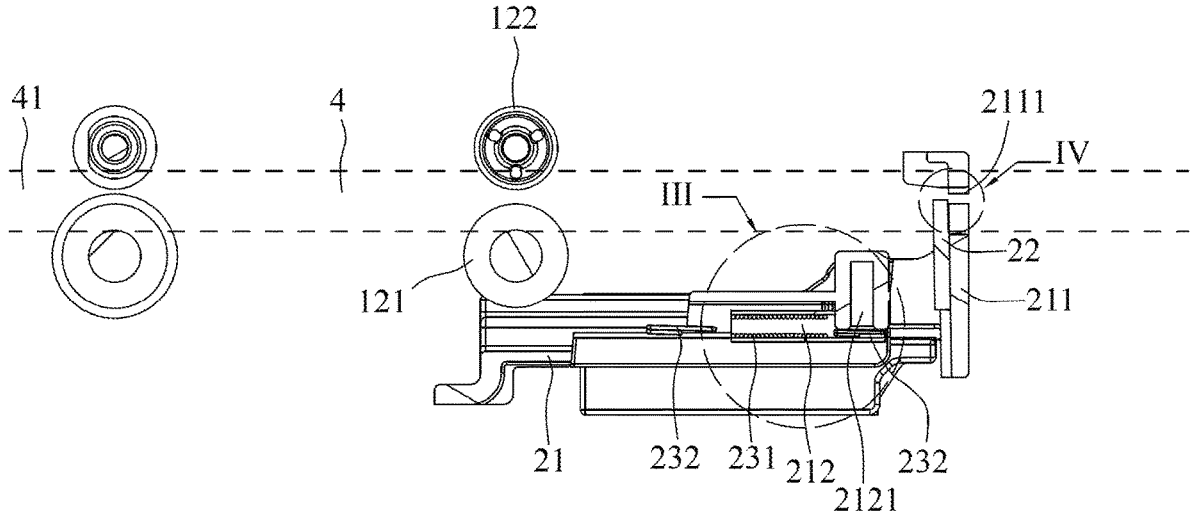
FIG. 2 is a sectional view alone line II-II shown in FIG. 1.
Figure 3:
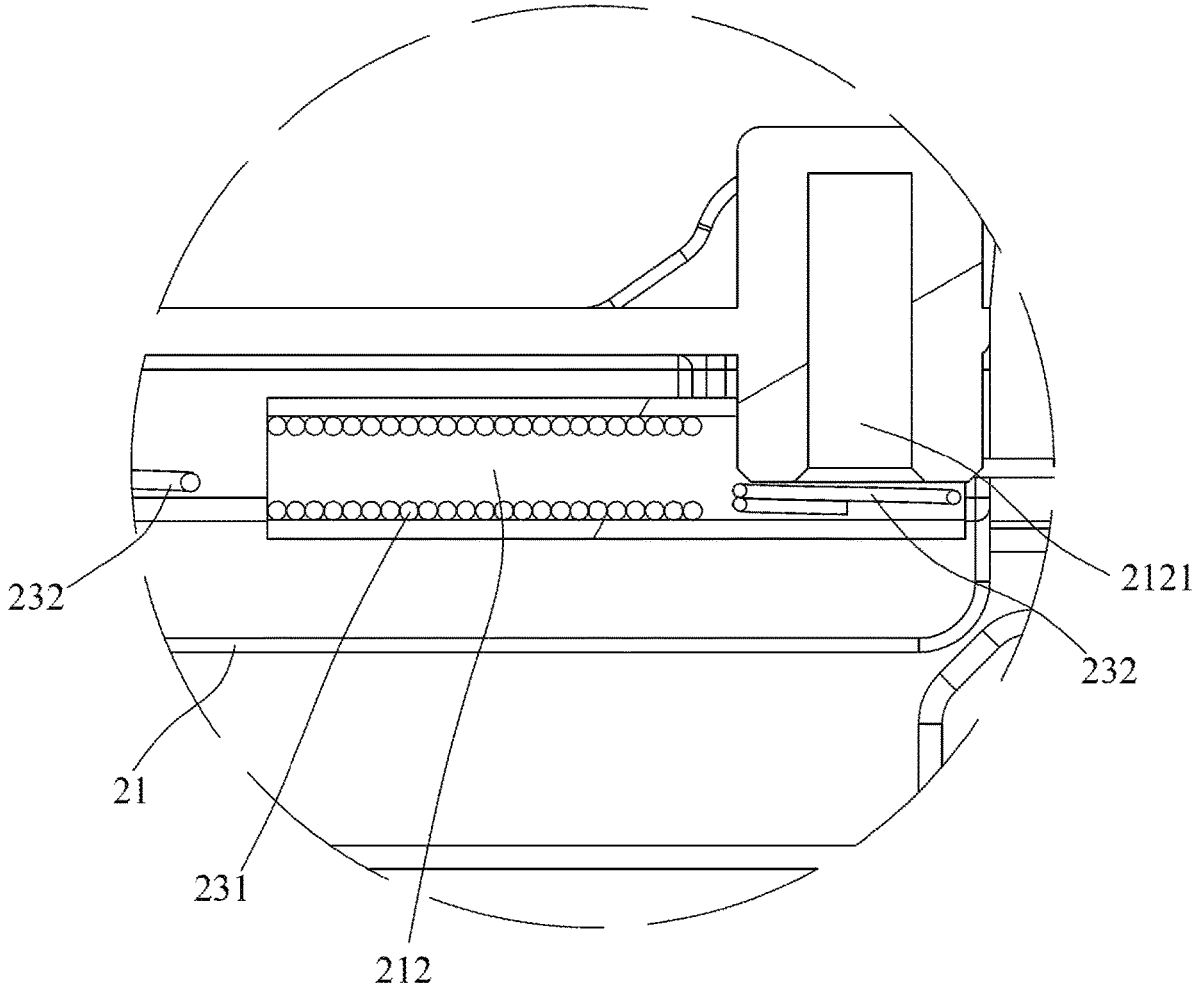
FIG. 3 is an enlarge view of section III shown in FIG. 2.
Figure 4:
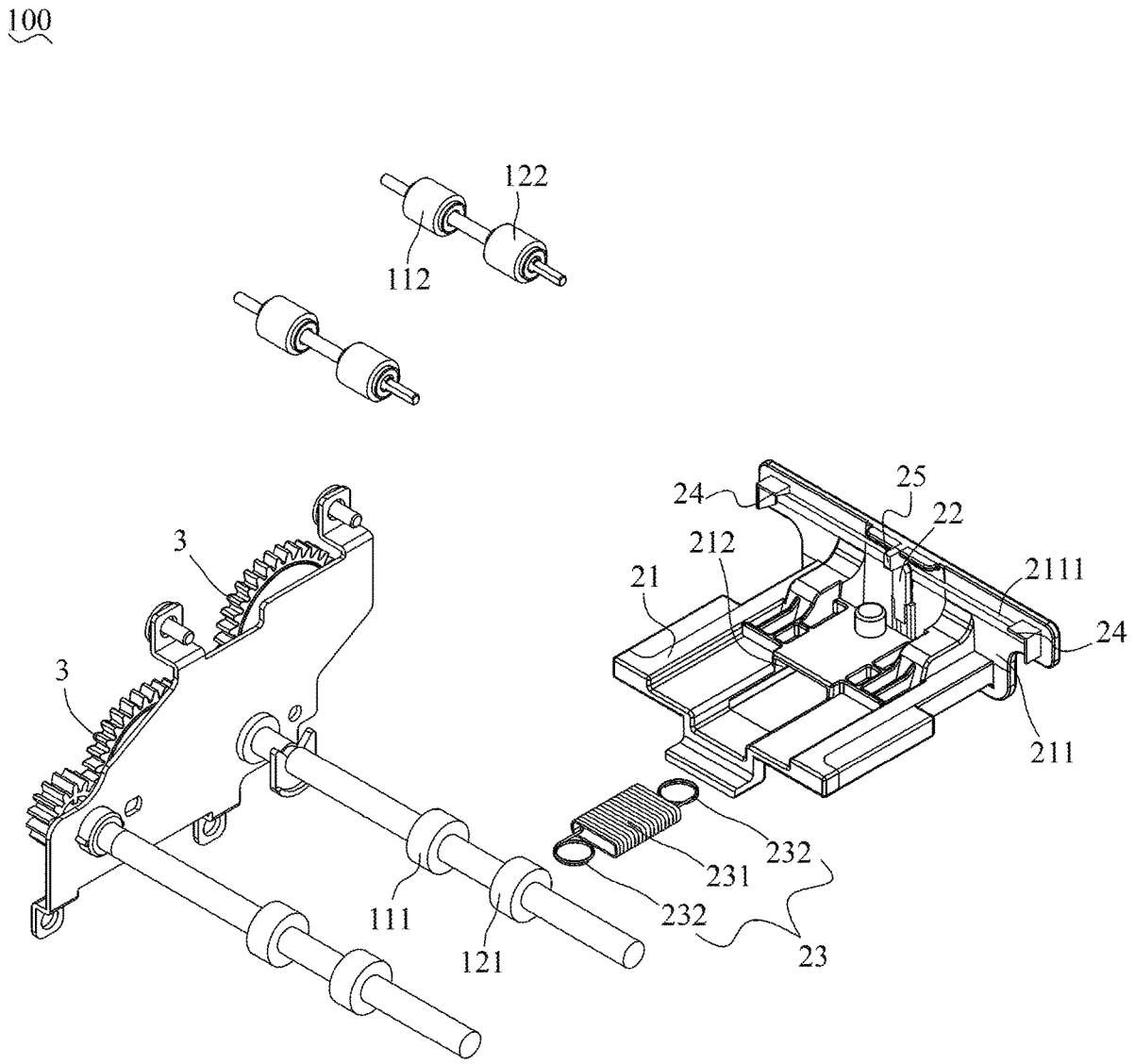
FIG. 4 is an exploded view of the correction structure in this invention.
Figure 5:
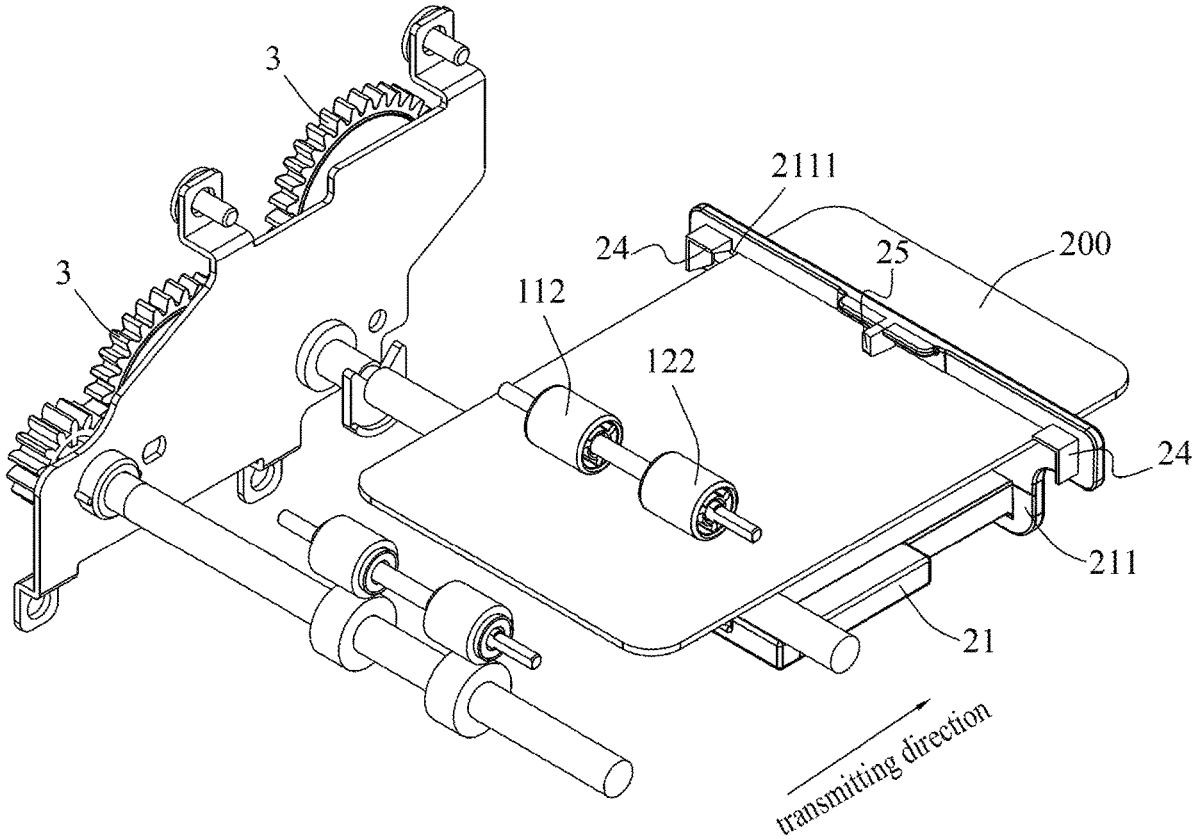
FIG. 5 is a perspective view showing a card before correction.
Figure 6:
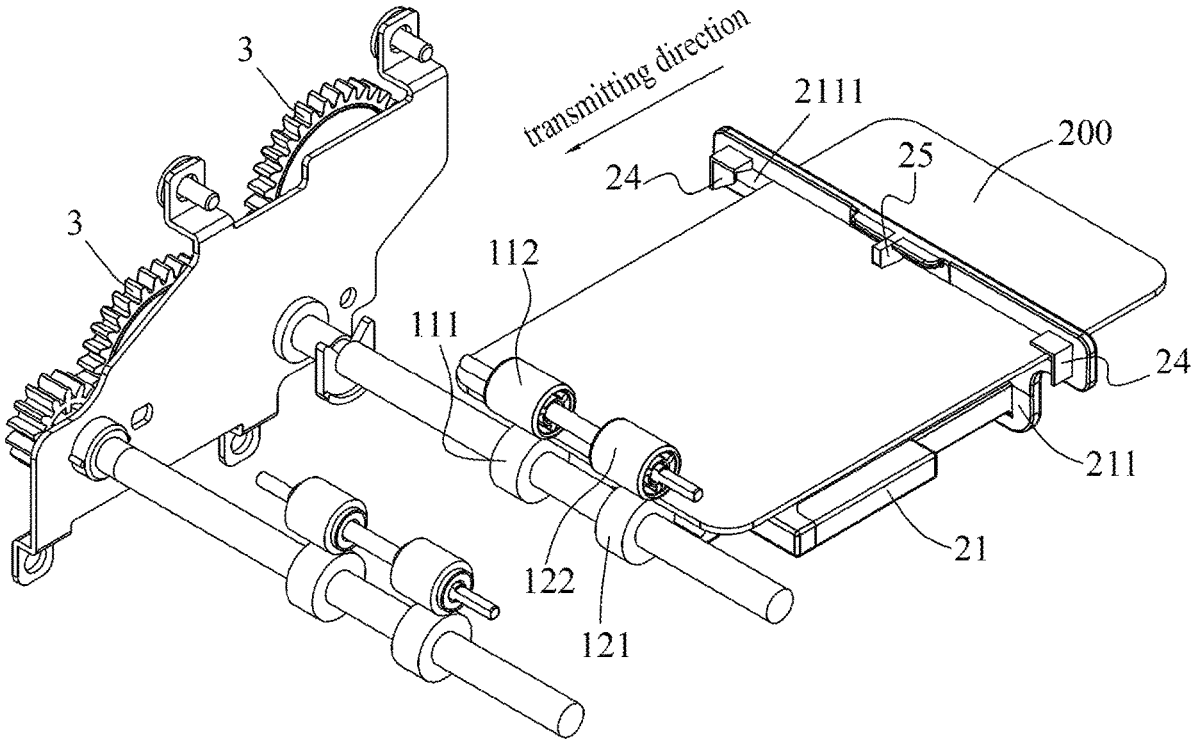
FIG. 6 is a perspective view showing the card after correction.

Referring to FIG. 2 to FIG. 4, the elastic object 23 in this embodiment is a spring 231 that connects the platform 21 and an inner structure of the document processing product (not shown), Each of two ends of the spring 231 is formed into a ring 232. A securing hole 2121 is formed in the receptacle 212. One of the rings 232 is secured to the securing hole 2121 via a securing means (not shown) such as a screw bolt. Therefore, the spring 231 is stretched when the platform 21 is pushed to the correction location by the card 200. The spring 231 drags the platform 21 back to the predefined location after the correcting device 2 completes card correction.

Referring to FIG. 4 to FIG. 11, the processes of correction are described as follow. When the card 200 is inserted from the entrance 41 of the feeding path 4, the motor is started to drive the first transmitting roller 111 and the second transmitting roller 121. The first transmitting roller 111 and the second transmitting roller 121 feed the card 200 toward the platform 21 and the opening 2111. When the card 200 arrives to the opening 2111, the front edge of the card 200 contacts with the friction pad 22 and receive a friction from the friction pad 22. The friction between the card 200 and the friction pad 22 overcomes the force of the spring 231, and the platform is dragged from the predefined location toward the correction location via the transmission force of the first roller set 11 and the second roller set 12 and the friction of the friction pad 22. When the transmission force of the transmitting device 1 overcomes the friction of the friction pad 22 and the force of the spring 231, front edge of the card 200 is transmitted to cross the friction pad 22 and pass through the opening 2111. The spring 231 is stretched when the card 200 is transmitted through the opening 2111.

Figure 7:
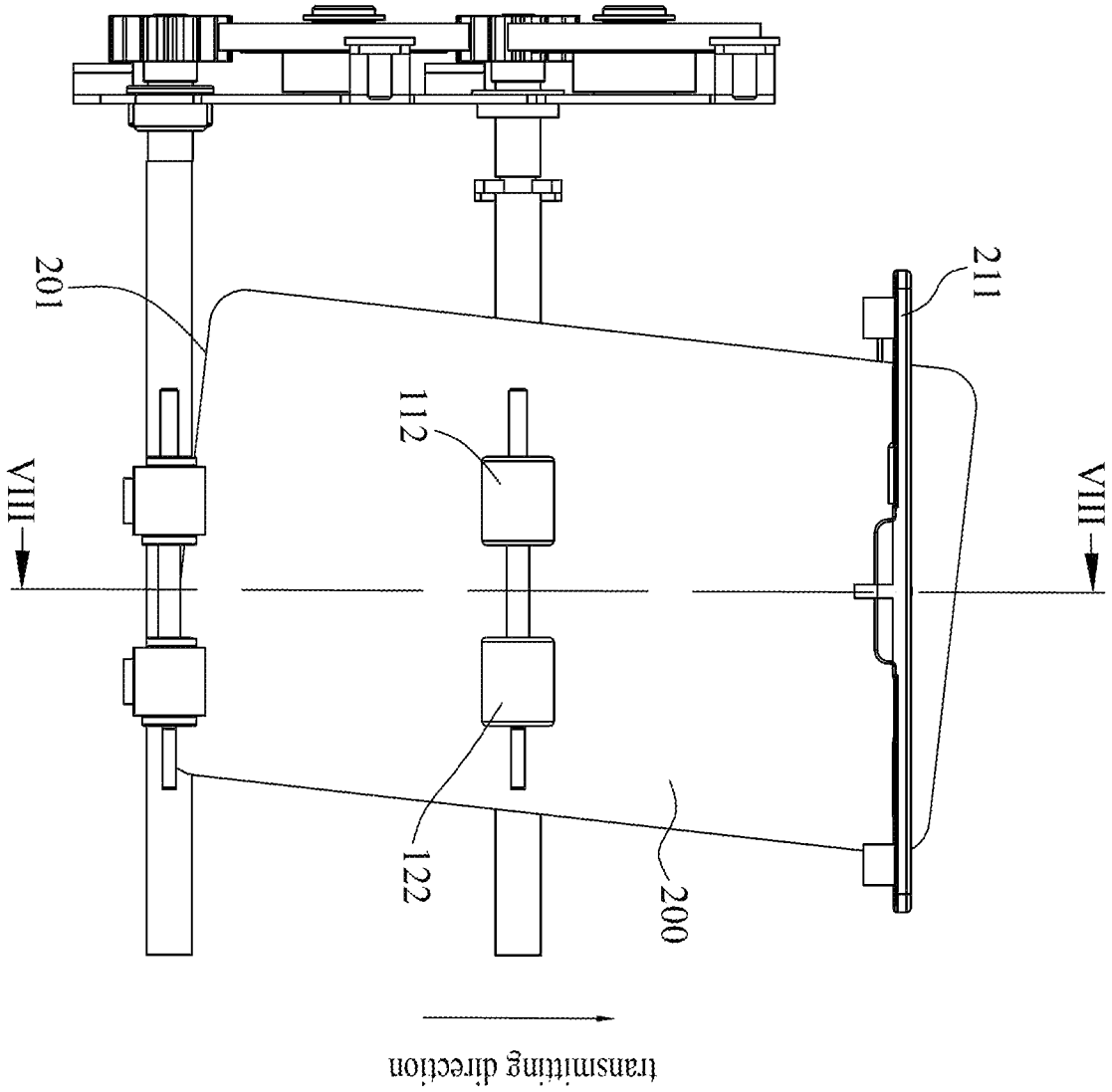
FIG. 7 is a top view showing the card before correction.
Figure 8:
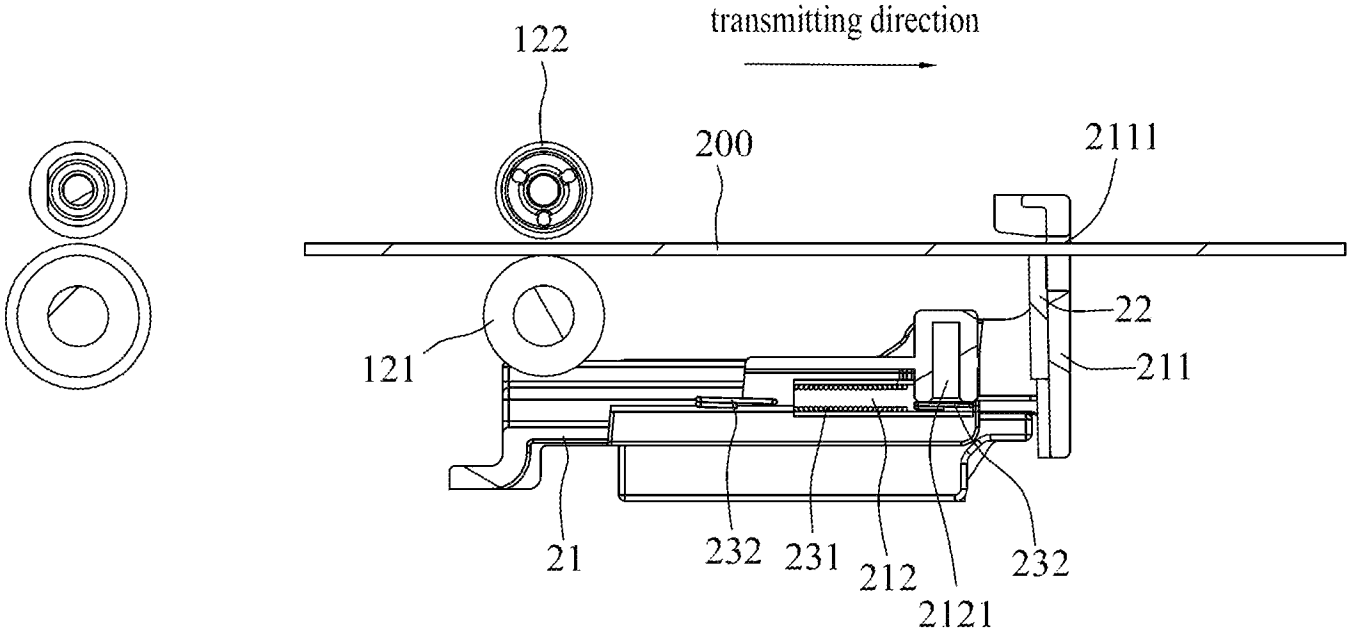
FIG. 8 is a sectional view alone line VIII-VIII shown in FIG. 7.
Figure 9:
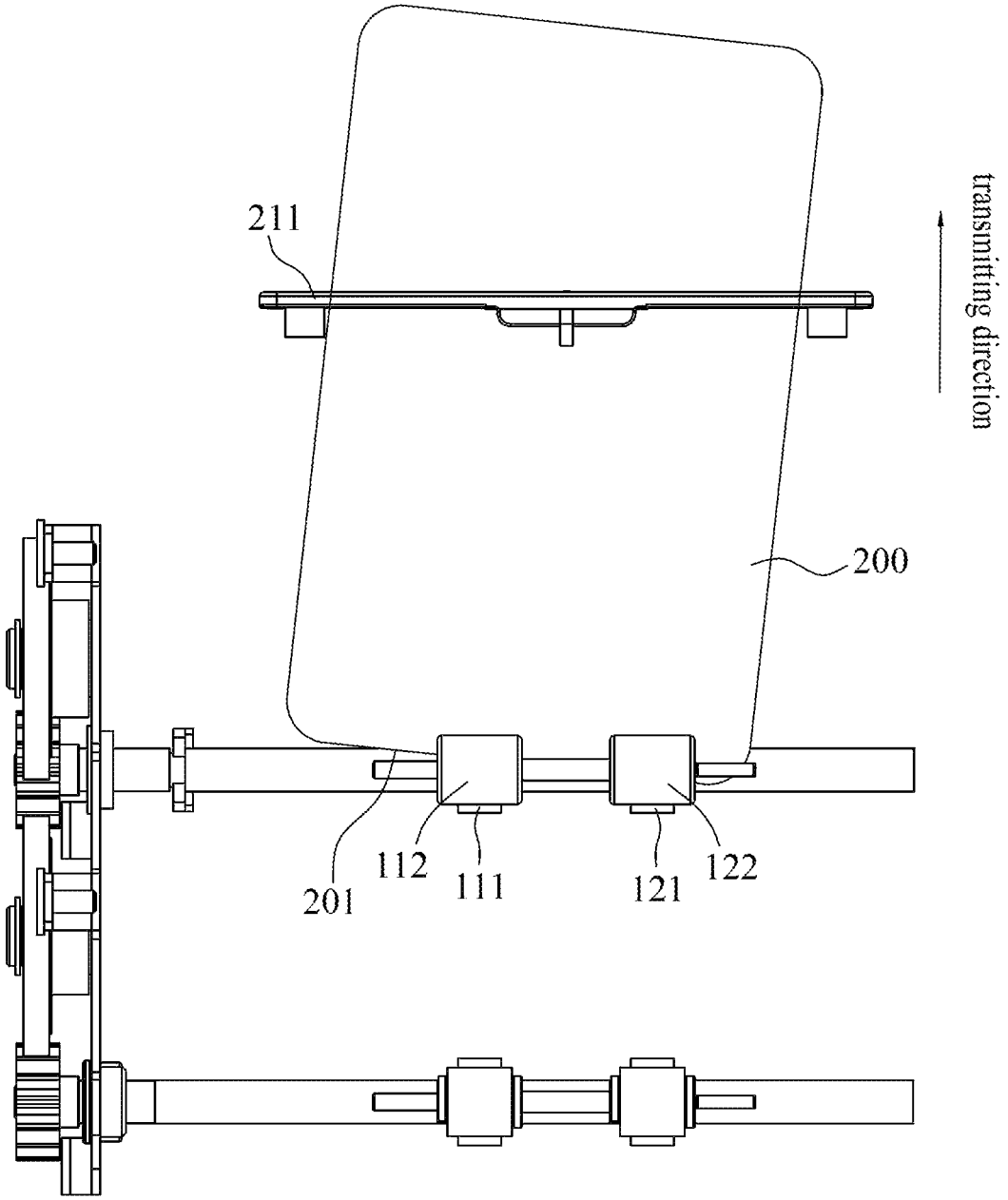
FIG. 9 is a top view showing the card before correction.
Figure 10:
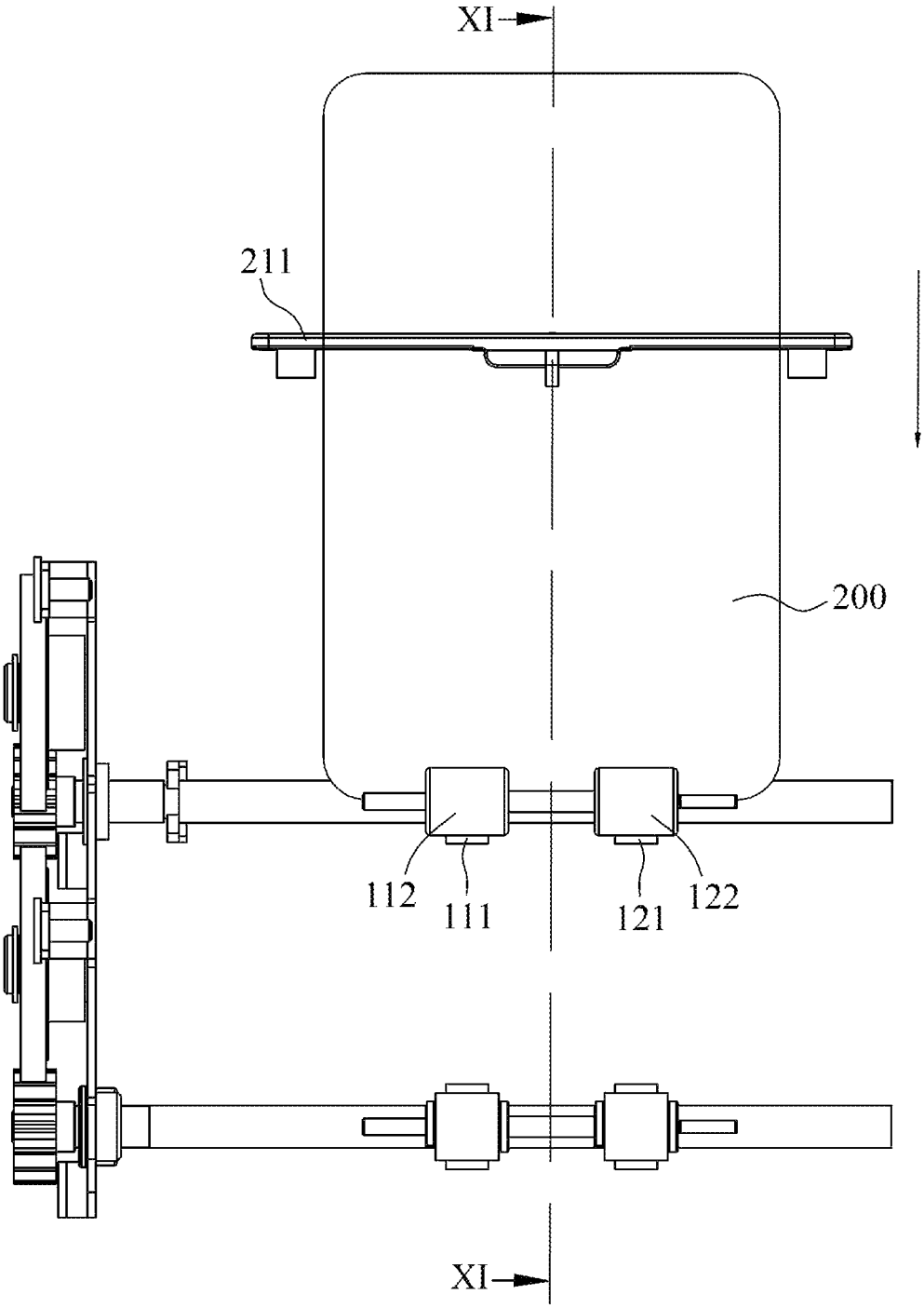
FIG. 10 is a top view showing the card being corrected by a correcting device.

As shown in FIG. 7 and FIG. 8, If the card 200 is skewed, a left side of the card 200 leaves the first roller set 11 before a right side of the card 200. Referring to FIG. 9, the card 200 only contacts the second roller set 12 positioned at a right of the feed path 4 and the second roller set 12 keeps applying the transmission force to the card 200 at the right side of the card 200. Meanwhile, the friction pad 22 also applies the friction to the card 200 at a center of a bottom surface of the card 200. The transmission force and the friction of the friction pad 22 generate a moment which rotates the card 200 counter clock-wise as shown in FIG. 10 and FIG. 11. Thus the moment corrects the skewed of the card 200. Furthermore, when the card 200 is fed out by the second roller set 12, the spring 231 drags the platform 21 and the card 200 back to the second roller set 12. Thus The right side and the left side of the card 200 are pushed to contact the first roller set 11 and the second roller set 12 to correct the skew of the card 200.

After the card 200 is corrected, the motor reverses to drive the first roller set 11 and the second roller set 12 to transmit the card 200 backward for processing the card 200 such as printing or scanning via the document processing means (not shown). The motor keeps rotating to drive the transmitting device 1 to eject the card 200 from the entrance 41.

Figure 12:
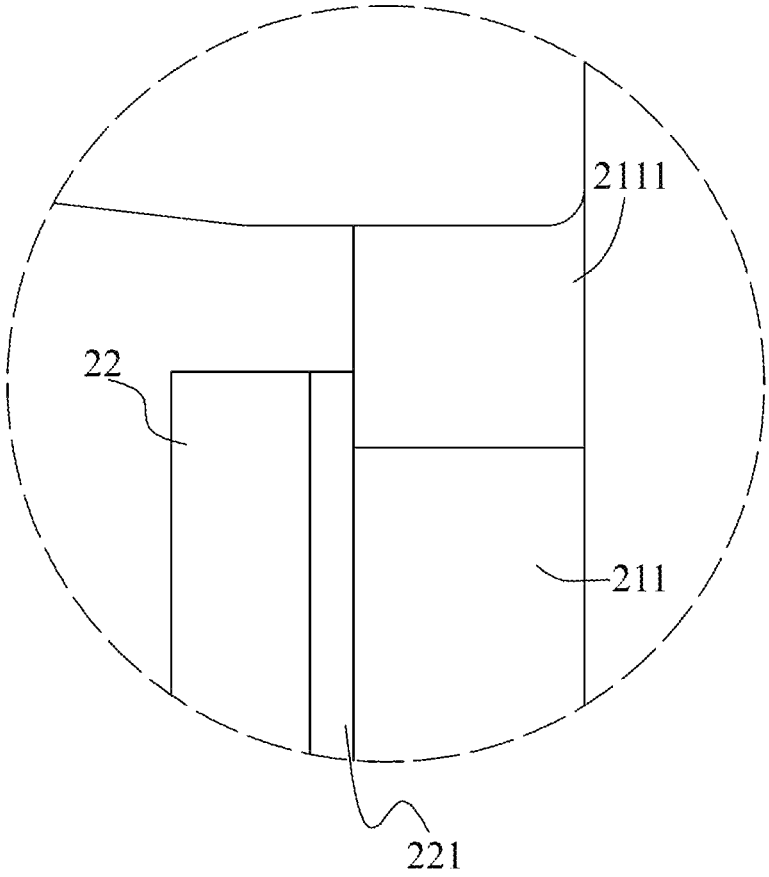
FIG. 12 is an enlarge view of section IV shown in FIG. 2.

Referring to FIG. 2 and FIG. 12, in some embodiment, the correcting device 2 includes a low-friction pad 221 arranged between the friction pad 22 and the back wall 211. The friction pad 22 and the low-friction pad 221 are all made of soft material and easy to be bend. The card 200 contacts with the friction pad 22 when the card 200 is transmitted forward and toward the downstream position of the feeding path. The card 200 contacts with the low-friction pad 221 when the card 200 is transmitted backward and toward the upstream position of the feeding path 4. The low-friction pad 221 is adhered between the friction pad 22 and the back wall 211.

Figure 13:
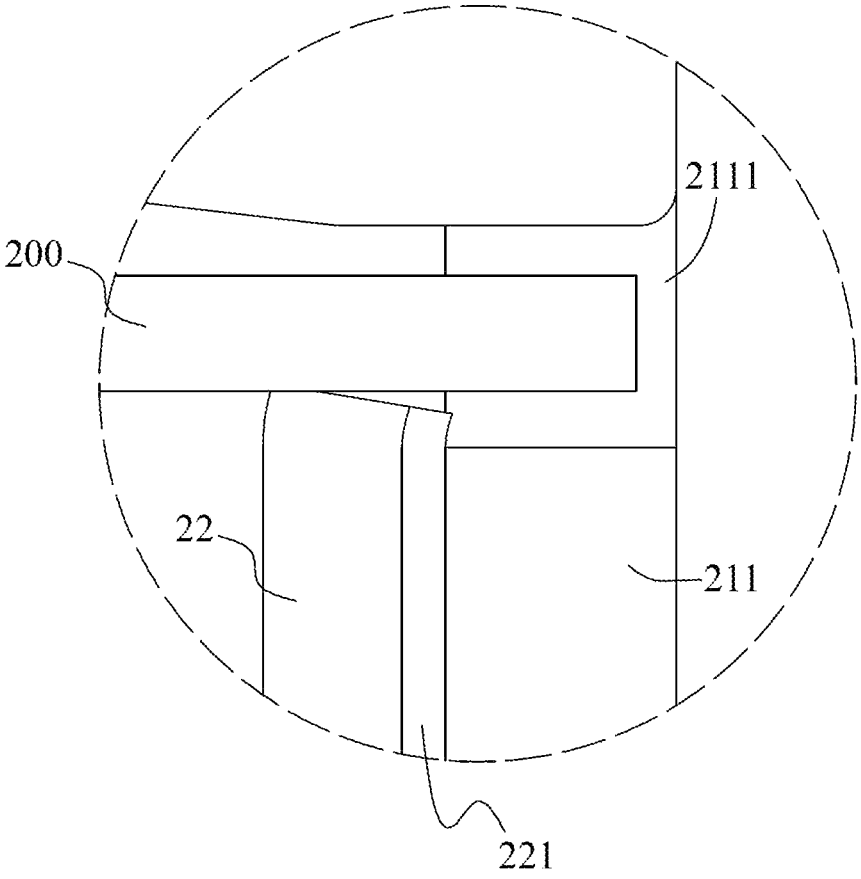
FIG. 13 is an enlarge view showing the card being transmitted forward and abutted against a friction pad of the correction device.
Figure 14:
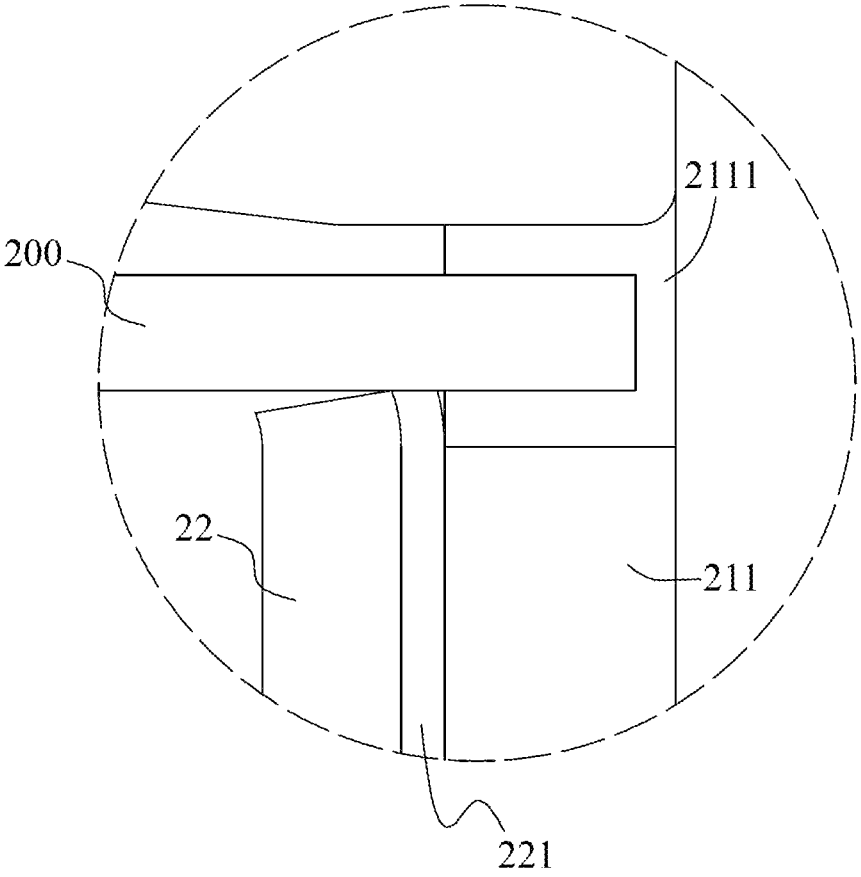
FIG. 14 is an enlarge view showing the card being transmitted backward and abutted against the friction of the correction device.

Referring to FIG. 13 and FIG. 14, as a result, when the card 200 is transmitted forward, the card 200 contacts with the friction pad 22 for being corrected. However, when the card 200 is transmitted backward for being processing or ejecting, the friction pad 22 will be dragged backward by the friction. Thus the card 200 contacts with the low-friction pad 221 to reduce the friction applied to the card 200.

In summary, the correction structure 100 in this invention corrects the skew of the card 200 via the transmitting means 1 and the correcting means 2 for improving scanning or printing result.

What is claimed is:

1. A skew correction structure which is arranged along a feeding path of a document processing product for correcting a card, comprising:

a transmitting device having at least a pair of roller sets which are arranged symmetrically on two sides of the feeding path for transmitting the card evenly; and a correcting device arranged at a downstream position of the feeding path, the correcting device having a platform movably arranged in parallel with the feeding path, an elastic object connected between the platform and the document processing product, a back wall extended from the platform and blocking the feeding path, an opening penetrating the back wall and communicating with the feeding path, a friction pad arranged at the back wall and blocking a middle of the opening from one of two long edges of the opening;

wherein a width of the friction pad is less than a width of the card, and the friction pad contacts a center of the card when the card is corrected.

2. The skew correction structure as claimed in claim 1, wherein each roller set comprises at least one transmitting roller and at least one idle roller arranged on a top of the transmitting roller, and the quantity of the idle roller is equal to the quantity of the transmitting roller.

3. The skew correction structure as claimed in claim 1, wherein the friction pad is arranged on an inner surface of the back wall.

4. The skew correction structure as claimed in claim 1, wherein the friction pad is arranged on an outer surface of the back wall.

5. The skew correction structure as claimed in claim 1, wherein the elastic object is a spring.

6. The skew correction structure as claimed in claim 5, wherein two rings are arranged on two ends of the spring respectively, and one of the rings is connected to the platform and the other ring is secured on the document processing product.

7. The skew correction structure as claimed in claim 6, wherein a securing hole is formed in a receptacle formed on the platform, and one of the rings is positioned on the securing hole to be secured via a securing means for securing the ring to the platform.

8. The skew correction structure as claimed in claim 1, wherein a low-friction pad is arranged between the friction pad and the back wall.

9. The skew correction structure as claimed in claim 8, wherein the low-friction pad is adhered between the friction pad and the back wall.

10. The skew correction structure as claimed in claim 1, wherein the correcting device comprises a pair of lateral guiders, the opening has opposite short edges, and the lateral guiders are positioned at an inner surface of the back wall and neighbored the short edges of the opening.

11. The skew correction structure as claimed in claim 10, wherein inner surfaces of the lateral guiders are formed as an oblique surface for guiding lateral edges of the card.

12. The skew correction structure as claimed in claim 10, wherein an inner surface of the middle guider is formed as an oblique surface for guiding a front edge of the card.

13. The skew correction structure as claimed in claim 1, wherein the correcting device comprises a middle guider, and the middle guider is positioned at an inner surface of the back wall and neighbored on a middle of the other long edge of the opening.

14. The skew correction structure as claimed in claim 1, wherein the friction pad is arranged at a bottom of the opening, a top of the friction pad fully blocks the middle of the opening, and a top edge of the friction pad and an upper edge of the opening are substantially at the same level along an up-down direction seen from a lateral side of the skew correction structure.

15. The skew correction structure as claimed in claim 1, wherein the friction pad is arranged at a top of the opening, a bottom of the friction pad fully blocks the middle of the opening, and a bottom edge of the friction pad and a lower edge of the opening are substantially at the same level along an up-down direction seen from a lateral side of the skew correction structure.

16. A skew correction structure which is arranged along a feeding path of a document processing product for correcting a card, comprising:

a platform movably arranged to parallel with the feeding path;

an elastic object connected between the platform and the document processing product;

a back wall extended from the platform and blocking the feeding path;

an opening penetrating the back wall and communicating with the feeding path; and a friction pad arranged at the back wall and blocking a middle of the opening from a long edge of the opening;

wherein, when the card is transmitted in the feeding path and inside the document processing product, the platform is positioned in the document processing product and a front edge of the card has not yet been connected the friction pad;

when the card is transmitted and the front edge of the card connects the friction pad, the platform is extending out from the document processing product; and when the card is transmitted and the front edge of the card has crossed the friction pad and passed through the opening, the card is corrected via a transmission force and a friction between the friction pad and a center of a surface of the card.

17. A skew correction structure which is arranged along a feeding path of a document processing product for correcting a card, comprising:

a platform movably arranged in parallel with the feeding path;

an elastic object connected between the platform and the document processing product;

a back wall extended from the platform and blocking the feeding path;

an opening penetrating the back wall and communicating with the feeding path; and a friction pad arranged at the back wall and blocking a middle of the opening from one of two long edges of the opening.

18. The skew correction structure as claimed in claim 17, wherein a low-friction pad is adhered between the friction pad and an inner surface of the back wall.

19. The skew correction structure as claimed in claim 18, wherein the back wall has a pair of lateral guiders, the opening has opposite short edges, and the lateral guiders are positioned at the inner surface of the back wall and neighbored the short edges of the opening.

20. The skew correction structure as claimed in claim 19, wherein the back wall has a middle guider, and the middle guider is positioned at the inner surface of the back wall and neighbored on a middle of the other long edge of the opening.

* * * * *